US005407409A

United States Patent [19]

Tang

[11] Patent Number: 5,407,409

[45] Date of Patent: Apr. 18, 1995

[54] EXERCISER WITH FRICTION-TYPE RESISTANCE DEVICE

[76] Inventor: Chih-Yun Tang, No. 23, Lane 42, Po-Chueh St., Hsi-Chin Chen, Taipei Hsien, Taiwan, Prov. of China

[21] Appl. No.: 326,998

[22] Filed: Oct. 21, 1994

[51] Int. Cl.[6] ..... A63B 21/00; A63B 69/18

[52] U.S. Cl. ..... 482/70; 482/118

[58] Field of Search ..... 482/70, 71, 51, 52, 482/53, 54, 114, 118

[56] References Cited

U.S. PATENT DOCUMENTS

| | | | |
|---|---|---|---|
| 4,023,795 | 5/1977 | Pauls | 482/70 |
| 4,659,077 | 4/1987 | Stropkay | 482/70 |
| 4,867,443 | 9/1989 | Jensen | 482/70 |
| 4,948,121 | 8/1990 | Haaheim et al. | 482/70 |
| 5,299,996 | 4/1994 | Chi | 482/70 |

*Primary Examiner*—Stephen R. Crow
*Attorney, Agent, or Firm*—Townsend and Townsend Khourie and Crew

[57] ABSTRACT

An exerciser has a base, a pair of parallel guide rails disposed on the base, a pair of driven units mounted slidably and respectively on the guide rails, and a friction-type resistance device mounted on the base and connected operably to the driven units to resist movement of the driven units. The resistance device includes a friction wheel mounted rotatably on the base, a friction belt trained on the friction wheel, a tension spring interconnecting one end of the friction belt and the base, and first and second transmission rollers mounted rotatably on the base at two sides of the friction wheel. First and second clutch units couple a respective one of the first and second transmission rollers and the friction wheel only when the respective transmission roller rotates in a first direction to drive rotatably the friction wheel in the first direction. The friction wheel applies a force to the friction belt in a compressing direction of the tension spring while rotating in the first direction. An endless transmission belt is secured to the driven units and is looped around the first and second transmission rollers so that reciprocating sliding movement of the driven units along the guide rails enables the endless transmission belt to drive the first and second transmission rollers to rotate in opposite directions.

1 Claim, 6 Drawing Sheets

EXERCISER WITH FRICTION-TYPE RESISTANCE DEVICE

BACKGROUND OF THE INVENTION

1. Field of the Invention

The invention relates to an exerciser, more particularly to an exerciser with a friction-type resistance device.

2. Description of the Related Art

Referring to FIG. 1, a conventional ski exerciser is shown to comprise a base (A) with front and rear ends, and a pair of parallel guide rails (B) disposed on the base (A) and extending from the front end to the rear end of the base (A). A pair of driven units (C), such as pedals, are mounted slidably and respectively on the guide rails (B). Each of a pair of lever arms (D) has a bottom end connected pivotally to the front end of the base (A). A friction-type resistance device of the conventional ski exerciser includes a pair of guide rollers (E), an endless transmission belt (F), a friction wheel (G) and a friction belt (H).

Each of the guide rollers (E) has a vertically oriented axis and is mounted rotatably on a respective one of-the front and rear ends of the base (A) between the guide rails (B). The endless transmission belt (F) is trained around the guide rollers (E) and has two mounting portions secured respectively to the driven units (C). The friction wheel (G) is secured coaxially to a bottom surface of the guide roller (E) at the front end of the base (A). The friction belt (H), which may be a woven belt, is trained on a peripheral portion of the friction wheel (G).

When the user's feet drive the driven units (C) to slide reciprocatingly along the guide rails (B), the transmission belt (F) moves to drive rotatably and alternatingly the guide rollers (E) in clockwise and counterclockwise directions. The friction wheel (G) rotates with the guide rollers (E), thereby resulting in friction between the friction wheel (G) and the friction belt (H) for resisting movement of the driven units (C). This illustrates how an exercise effect is achieved when the conventional ski exerciser is in use.

FIG. 2 illustrates the connection between the friction wheel (G) and the friction belt (H) in greater detail. As illustrated, the friction belt (H) has a first end connected to the base (A) and a second end connected to a first end of a tension spring (I). The second end of the tension spring (I) is connected to a threaded shank of an adjustment unit (K) via a flexible strip (J). The adjustment unit (K) is mounted threadedly on the base (A) and is operable so as to adjust the tension of the friction belt (H) or the tightness of contact between the friction belt (H) and the friction wheel (G). The tension spring (I) permits even distribution of the tension force of the friction belt (H) therealong.

When the friction wheel (G) rotates in the direction indicated by the arrow (M), the friction belt (H) experiences a force in the compressing direction of the tension spring (I). In this case, constant frictional contact between the friction belt (H) and the friction wheel (G) is ensured. However, when the friction wheel (G) rotates in the opposite direction indicated by the arrow (N), the friction belt (H) experiences a force in the pulling direction of the tension spring (I). In this case, the tension spring (I) expands and contracts intermittently, thereby resulting in poor frictional contact between the friction belt (H) and the friction wheel (G).

In order to overcome the above drawback, it has been proposed that the tension spring (I) be removed, and that the second end of the friction belt (H) be connected directly to the threaded shank of the adjustment unit (K). However, if the tension force in the friction belt (H) is too large, the static friction force between the friction belt (H) and the friction wheel (G) would make it very difficult to operate the driven units (C). On the other hand, if the adjustment unit (K) is operated so as to reduce the tension force in the friction belt (H), a clearance might be formed between the friction belt (H) and the friction wheel (G) and thus, no friction force for resisting the movement of the driven units (C) will be generated.

SUMMARY OF THE INVENTION

Therefore, the objective of the present invention is to provide an exerciser with an improved friction-type resistance device that is capable of overcoming the above drawbacks commonly associated with the previously described conventional exerciser.

Accordingly, the exerciser of the present invention includes a base with front and rear ends, a pair of parallel guide rails disposed on the base and extending from the front end to the rear end of the base, a pair of driven units mounted slidably and respectively on the guide rails, and a friction-type resistance device mounted on the base and connected operably to the driven units to resist movement of the driven units.

The resistance device comprises an axle extending horizontally between the guide rails and having two ends mounted to one of the front and rear ends of the base. A friction wheel is mounted rotatably on the axle. A friction belt is trained on a peripheral portion of the friction wheel and has a first end connected to the base and a second end. A tension spring has a first end connected to the second end of the friction belt and a second end connected to the base. First and second transmission rollers are mounted rotatably and respectively on the axle at two sides of the friction wheel. A first clutch unit, mounted rotatably on the axle, couples the first transmission roller and the friction wheel only when the first transmission roller rotates in a first direction to drive rotatably the friction wheel in the first direction. The friction wheel applies a force to the friction belt in a compressing direction of the tension spring while rotating in the first direction. A second clutch unit, mounted rotatably on the axle, couples the second transmission roller and the friction wheel only when the second transmission roller rotates in the first direction to drive rotatably the friction wheel in the first direction. Guide rollers are mounted rotatably on the front and rear ends of the base between the guide rails. An endless transmission belt is trained around the guide rollers and has two mounting portions secured respectively to the driven units. The endless transmission belt further has two looped portions looped respectively around the first and second transmission rollers. The driven units are operable so as to slide reciprocatingly along the guide rails to enable the endless transmission belt to drive the first and second transmission rollers to rotate in opposite directions. Constant frictional contact between the friction belt and the friction wheel is ensured when the exerciser of the present invention is in use because the friction wheel rotates in only one direction.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
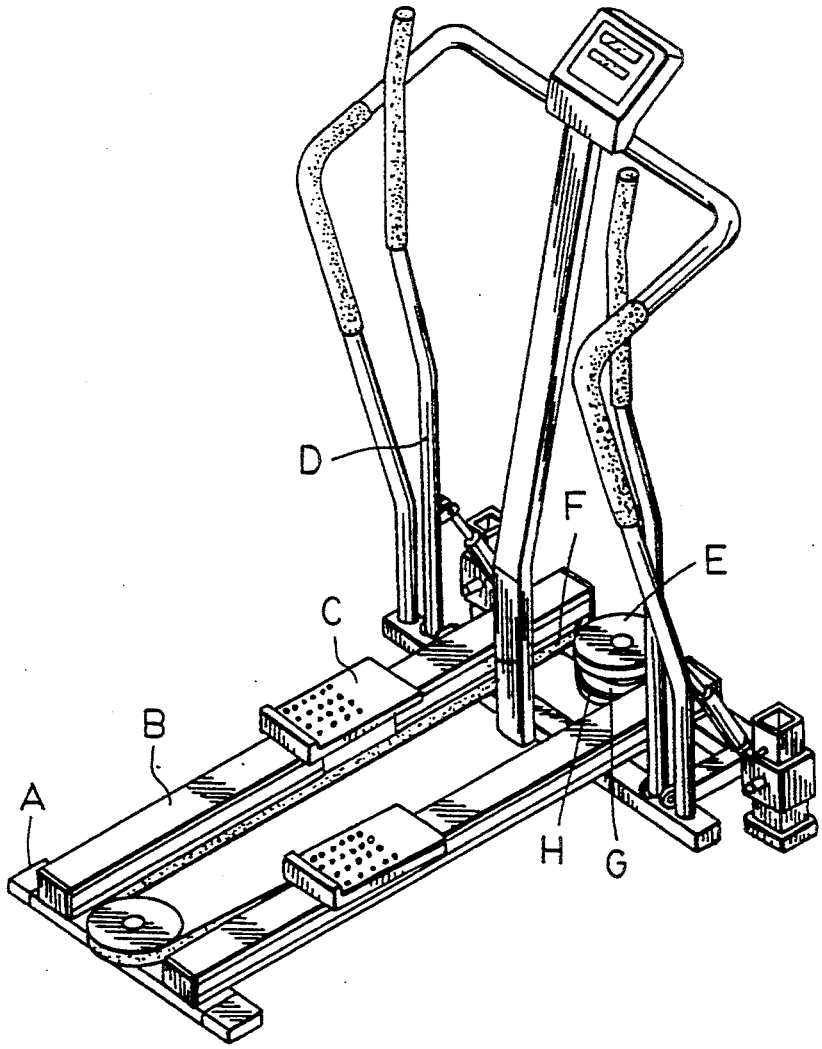
FIG.1 PRIOR ART
FIG. 1 is a perspective view of a conventional ski exerciser with a friction-type resistance device.
Figure 2:
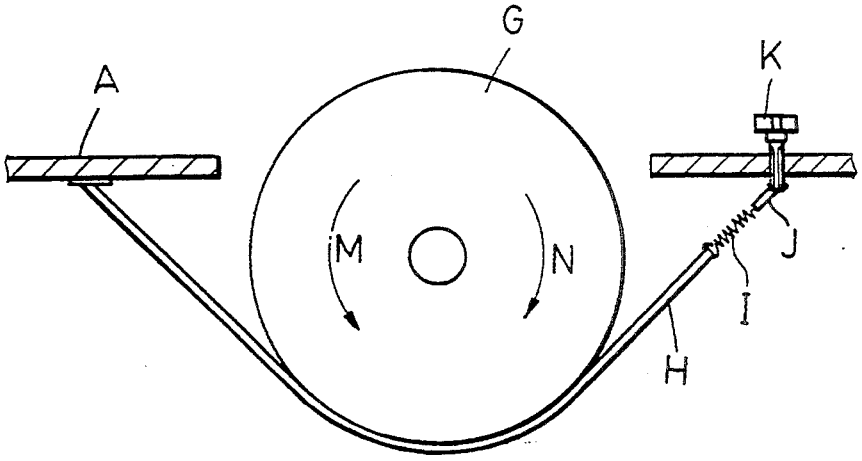
FIG.2 PRIOR ART
FIG. 2 is a schematic view of the resistance device of the conventional exerciser shown in FIG. 1.
Figure 3:
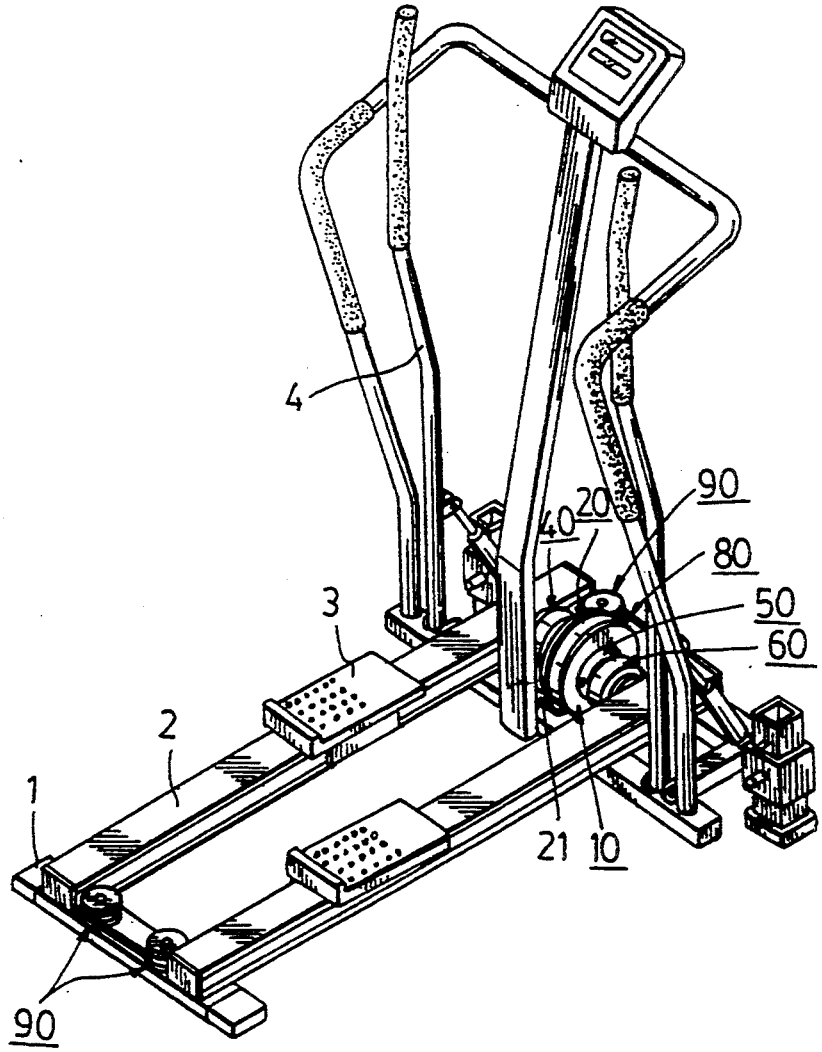
FIG. 3 is a perspective view of the preferred embodiment of an exerciser with a friction-type resistance device according to the present invention.

Referring to FIG. 3, the preferred embodiment of an exerciser according to the present invention is shown to be in the form of a ski exerciser and comprises a base 1 with front and rear ends, and a pair of parallel guide rails 2 disposed on the base 1 and extending from the front end to the rear end of the base 1. A pair of driven units 3, such as pedals, are mounted slidably and respectively on the guide rails 2. Each of a pair of lever arms 4 has a bottom end connected pivotally to the front end of the base 1.

Figure 4:
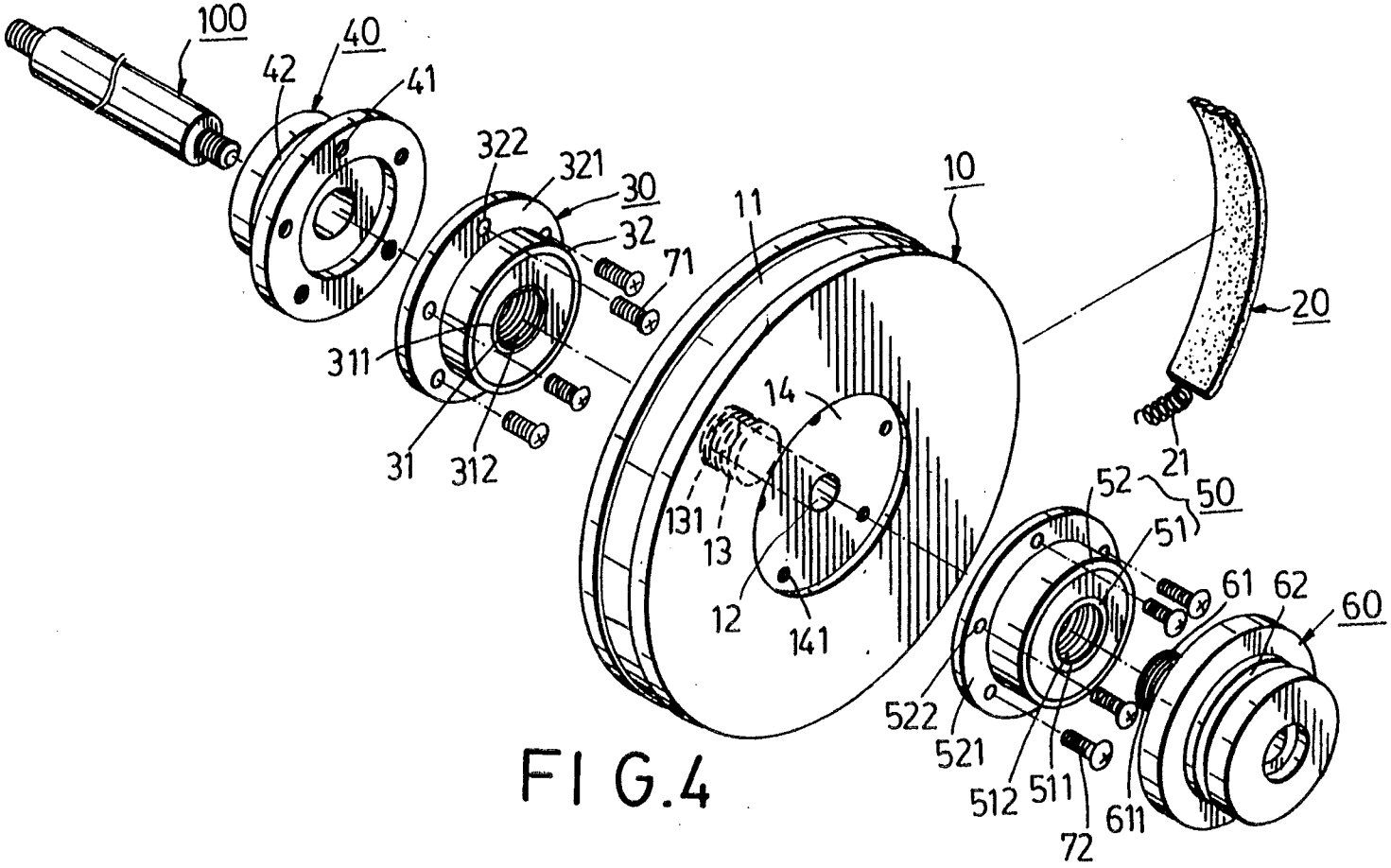
FIG. 4 is an exploded view of the resistance device of the preferred embodiment.

Referring to FIGS. 3 and 4, a friction-type resistance device of the exerciser includes an axle 100, a friction wheel 10, a friction belt 20, a first clutch unit 30, a first transmission roller 40, a second clutch unit 50, a second transmission roller 60, an endless transmission belt 80 and two pairs of guide rollers 90.

The axle 100 extends horizontally between the guide rails 2 and has two ends mounted to the front end of the base 1. The friction wheel 10 is formed with an endless peripheral groove 11 and an axial hole 12 for receiving the axle 100 therethrough. The friction wheel 10 is thus mounted rotatably on the axle 100. The friction wheel 10 further has a first side which is formed with an axially extending tubular extension 13 that is provided with an external screw thread 131, and a second side with a central circular recessed portion 14. The second side of the friction wheel 10 is further formed with a number of screw holes 141 in the recessed portion 14.

The friction belt 20, which may be a woven belt, is trained in the peripheral groove 11 of the friction wheel 10 and has a first end connected to the base 1 and a second end connected to a first end of a tension spring 21. The second end of the tension spring 21 is connected to the base 1 in a known manner. The tension spring 21 permits even distribution of the tension force of the friction belt 20 therealong.

Figure 5:
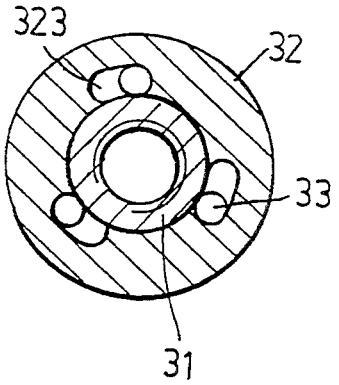
FIG. 5 is a sectional view of a clutch unit of the resistance device shown in FIG. 4.
Figure 6:
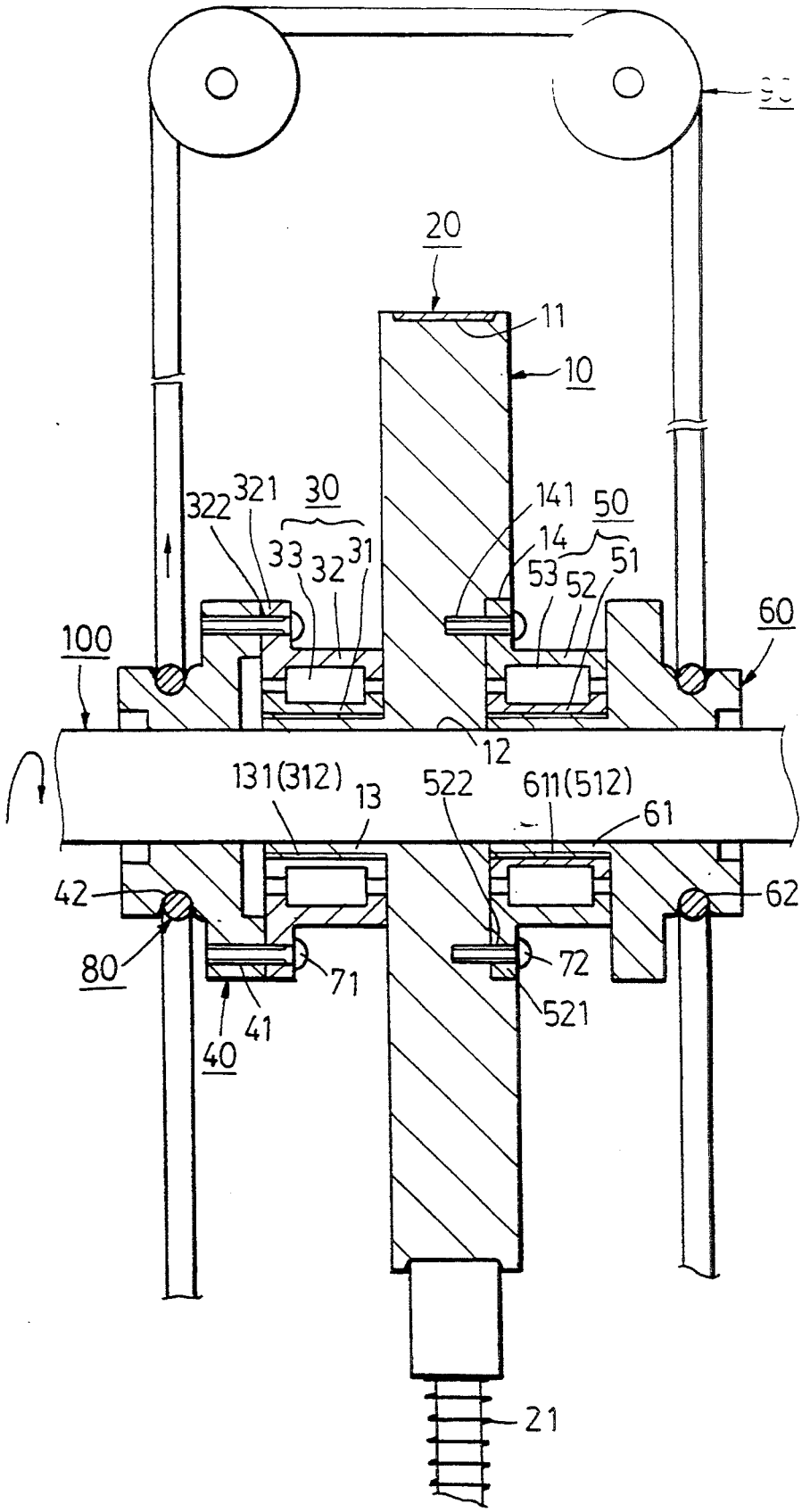
FIG. 6 is a sectional view illustrating the assembly of the resistance device shown in FIG. 4.

The first clutch unit 30 is generally similar in construction to the conventional unidirectional driving units commonly found in bicycle hubs and ratchet tools. Referring to FIGS. 4 to 6, the first clutch unit 30 is mounted rotatably on the axle 100 at one side of the friction wheel 10 and includes an inner race 31, an outer race 32 and a clutch means 33 between the inner and outer races 31, 32. The inner race 31 is a ring-shaped member which confines an axial through-hole 311 that is formed with an internal screw thread 312 for engaging threadedly the external screw thread 131 on the tubular extension 13. The outer race 32 is disposed around the inner race 31 and has one end formed with a radial mounting flange 321 that is provided with a number of mounting holes 322. As shown in FIG. 5, which is a sectional view of the first clutch unit 30, the outer race 32 further has an inner wall surface formed with a plurality of ratchet grooves 323, and the clutch means 33 includes a plurality of cylindrical members received in the ratchet grooves 323. When the outer race 32 rotates in a first direction, the clutch means 33 locks the inner race 31 to the outer race 32 to permit rotation of the inner race 31 with the outer race 32. The clutch means 33 disengages the inner race 31 when the outer race 32 rotates in a second direction opposite to the first direction, thereby permitting free rotation of the outer race 32.

The first transmission roller 40 is a cylindrical member which is mounted rotatably on the axle 100. The first transmission roller 40 has one end adjacent to the first clutch unit 30 which is formed with a radial mounting flange that is provided with a number of threaded mounting holes 41 to be aligned with the mounting holes 322 in the outer race 32 of the first clutch unit 30. Screws 71 extend through the mounting holes 322 and engage threadedly the mounting holes 41 to secure the first transmission roller 40 to the outer race 32 of the first clutch unit 30. The first transmission roller 40 is further formed with an endless peripheral groove 42.

The second clutch unit 50 is substantially similar in construction to the first clutch unit 30 and is mounted rotatably on the axle 100 at the other side of the friction wheel 10. The second clutch unit 50 includes an inner race 51, an outer race 52 and a clutch means (not shown) between the inner and outer races 51, 52. The inner race 51 is a ring-shaped member which confines an axial through-hole 511 that is formed with an internal screw thread 512. The outer race 52 is disposed around the inner race 51 and has one end formed with a radial mounting flange 521 that is received in the recessed portion 14 of the friction wheel 10. The radial mounting flange 521 is provided with a number of mounting holes 522 which are aligned with the screw holes 141 in the friction wheel 10. Screws 72 extend through the mounting holes 522 and engage threadedly the screw holes 141 to secure the outer race 52 of the second clutch unit 50 to the friction wheel 10. As with the first clutch unit 30, when the outer race 52 rotates in the first direction, the clutch means of the second clutch unit 50 locks the inner race 51 to the outer race 52 to permit rotation of the inner race 51 with the outer race 52. The clutch means of the second clutch unit 50 disengages the inner race 51 when the outer race 52 rotates in the second direction, thereby permitting free rotation of the outer race 52.

The second transmission roller 60 is substantially similar to the first transmission roller 40 and is similarly formed as a cylindrical member which is mounted rotatably on the axle 100. The second transmission roller 60 has one end adjacent to the second clutch unit 50 which is formed with an axial tubular extension 61 that is provided with an external screw thread 611. The external screw thread 611 of the tubular extension 61 engages threadedly the internal screw thread 512 of the inner race 51 to secure the second transmission roller 60 to the inner race 51 of the second clutch unit 50. The second transmission roller 60 is further formed with an endless peripheral groove 62.

Figure 7:
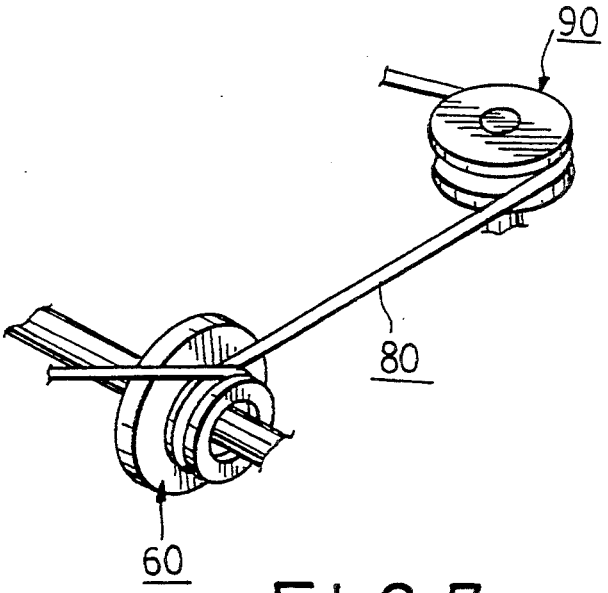
FIG. 7 illustrates the connection among a transmission roller, an endless transmission belt, and a guide roller of the resistance device shown in FIG. 4.

Referring to FIGS. 3, 6 and 7, each pair of guide rollers 90 is mounted rotatably on a respective one of the front and rear ends of the base 1 between the guide rails 2 such that the axes of the guide rollers 90 are oriented vertically. The assembly of the friction wheel 10, the first and second clutch units 30, 50 and the first and second transmission rollers 40, 60 is mounted rotatably on the axle 100 before the axle 100 is secured to the base 1. The endless transmission belt 80 is trained around the guide rollers 90 and has two mounting portions secured respectively to the driven units 3. The endless transmission belt 80 further has two looped portions looped respectively around the peripheral grooves 42, 62 of the first and second transmission rollers 40, 60.

When the user's feet drive the driven units 3 to slide reciprocatingly along the guide rails 2, the endless transmission belt 80 moves to drive rotatably the first and second transmission rollers 40, 60 in opposite directions. As the first transmission roller 40 rotates in the first direction, the outer race 32 of the first clutch unit 30 rotates in the same direction to enable the clutch means 33 to lock the inner race 31 to the outer race 32 so as to permit rotation of the inner race 31 with the outer race 32. Since the inner race 31 is connected to the friction wheel 10, the friction wheel 10 similarly rotates in the first direction to result in friction between the friction wheel 10 and the friction belt 20 for resisting movement of the driven units 3. At this stage, the friction wheel 10 applies a force to the friction belt 20 in a compressing direction of the tension spring 21 so as to ensure constant frictional contact between the friction wheel 10 and the friction belt 20.

When the endless transmission belt 80 moves to drive rotatably the first transmission roller 40 in the second direction, the first transmission roller 40 drives rotatably the outer race 32 of the first clutch unit 30 in the same direction, thereby resulting in free rotation of the outer race 32. However, since the transmission belt 80 drives rotatably the second transmission roller 60 in the first direction, the second transmission roller 60 is able to drive rotatably the inner race 51 of the second clutch unit 50 in the same direction. At this stage, the clutch means of the second clutch unit 50 locks the inner race 51 to the outer race 52 so as to permit rotation of the outer race 52 with the inner race 51. Since the outer race 52 is connected to the friction wheel 10, the friction wheel 10 similarly rotates in the first direction to result in friction between the friction wheel 10 and the friction belt 20 for resisting movement of the driven units 3.

It has thus been shown that the friction wheel 10 rotates in only one direction when the driven units 3 are operated reciprocatingly. Thus, the friction belt 20 only experiences a force in the compressing direction of the tension spring 21 to ensure constant frictional contact between the friction belt 80 and the friction wheel 10. The object of the present invention is thus achieved.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An exerciser including a base with front and rear ends, a pair of parallel guide rails disposed on said base and extending from said front end to said rear end of said base, a pair of driven units mounted slidably and respectively on said guide rails, and a friction-type resistance device mounted on said base and connected operably to said driven units to resist movement of said driven units, wherein said resistance device comprises:

an axle extending horizontally between said guide rails and having two ends mounted to one of said front and rear ends of said base;

a friction wheel mounted rotatably on said axle;

a friction belt trained on a peripheral portion of said friction wheel, said friction belt having a first end connected to said base and a second end;

a tension spring having a first end connected to said second end of said friction belt and a second end connected to said base;

first and second transmission rollers mounted rotatably and respectively on said axle at two sides of said friction wheel;

a first clutch unit, mounted rotatably on said axle, for coupling said first transmission roller and said friction wheel only when said first transmission roller rotates in a first direction to drive rotatably said friction wheel in said first direction, said friction wheel applying a force to said friction belt in a compressing direction of said tension spring while rotating in said first direction;

a second clutch unit, mounted rotatably on said axle, for coupling said second transmission roller and said friction wheel only when said second transmission roller rotates in said first direction to drive rotatably said friction wheel in said first direction;

guide rollers mounted rotatably on said front and rear ends of said base between said guide rails; and an endless transmission belt trained around said guide rollers and having two mounting portions secured respectively to said driven units, said endless transmission belt further having two looped portions looped respectively around said first and second transmission rollers;

said driven units being operable so as to slide reciprocatingly along said guide rails to enable said endless transmission belt to drive said first and second transmission rollers to rotate in opposite directions.

* * * * *